US005611913A

United States Patent [19]

Yan

[11] Patent Number: 5,611,913

[45] Date of Patent: Mar. 18, 1997

[54] DISSOLVING SALT FOR SOLID CAUSTIC WITH OIL

[75] Inventor: Tsoung Y. Yan, Wayne, Pa.

[73] Assignee: Mobile Oil Corporation, Fairfax, Va.

[21] Appl. No.: 367,412

[22] Filed: Dec. 30, 1994

[51] Int. Cl.[6] ..... C10G 19/00

[52] U.S. Cl. ..... 208/140; 208/62; 208/138; 208/139; 208/97; 208/99

[58] Field of Search ..... 208/97, 99, 100, 208/132, 262.1, 308, 62, 138–140

[56] References Cited

U.S. PATENT DOCUMENTS

| | | | |
|---|---|---|---|
| 2,481,300 | 9/1949 | Engel | 208/230 |
| 3,254,137 | 5/1966 | Hutto et al. | 260/683.48 |
| 3,658,694 | 4/1972 | McCleary | 208/230 |
| 3,761,534 | 9/1973 | Sun et al. | 260/674 |
| 4,316,998 | 2/1982 | Van Pool | 585/712 |
| 5,330,946 | 7/1994 | Hynes et al. | 502/82 |

*Primary Examiner*—Helane Myers

*Attorney, Agent, or Firm*—Malcolm D. Keen; Thomas W. Steinberg

[57] ABSTRACT

Acidic halides, especially chlorides, are removed from dry process vapor and liquid hydrocarbon streams by contact with solid caustic, such as a bed of NaOH. Salt deposits from form on the solid caustic, which are periodically removed by passing a liquid hydrocarbon continuous phase containing a minor amount of dissolved or entrained water over the solid caustic. Salts may be removed from the liquid hydrocarbon by extraction with water, which also saturates the liquid hydrocarbon so that it may be used to remove additional salt deposits.

9 Claims, 1 Drawing Sheet

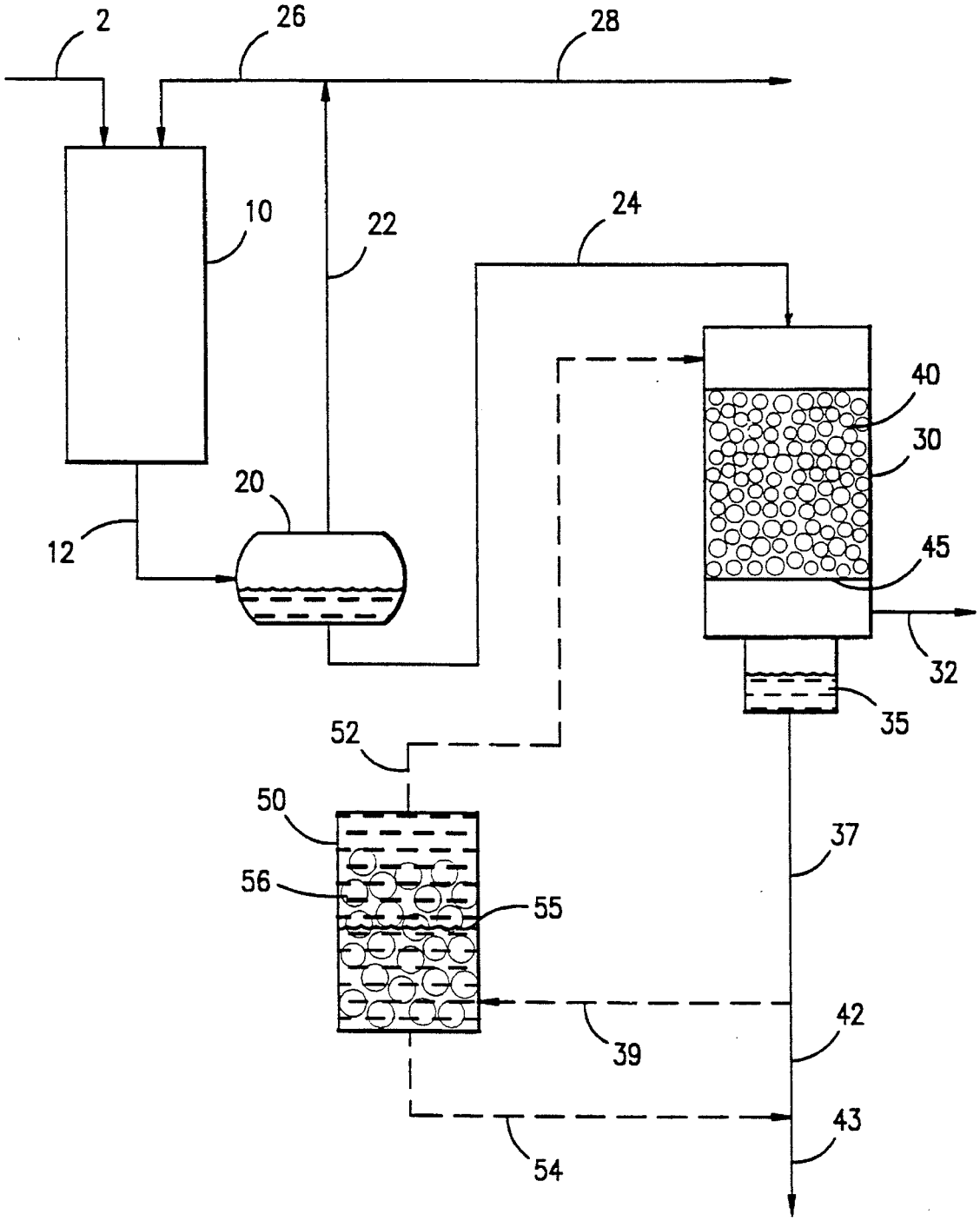
2
26
28
10
22
24
40
30
20
12
45
32
35
52
50
37
56
55
42
39
43
54

DISSOLVING SALT FOR SOLID CAUSTIC WITH OIL

CROSS-REFERENCE TO RELATED APPLICATIONS

This application is related to my prior co-pending application Ser. No. 08/217,821 filed on Mar. 25, 1994.

This application is also related to other applications of mine filed simultaneously with this application directed to:

| DOCKET | TITLE |
|---|---|
| 7579 | TWO PHASE TREATMENT OF VAPOR TO REMOVE HALIDES |
| 7580 | QUADRI PHASE TREATMENT OF VAPOR TO REMOVE HALIDES |
| 7581 | TWO PHASE REMOVAL OF HALIDES FROM LIQUID HYDROCARBONS |
| 7582 | THREE PHASE REMOVAL OF HALIDES FROM LIQUID HYDROCARBONS |
| 7583 | REMOVAL OF ACIDIC HalideS FROM HOT GAS STREAMS AND ATTRITION REGENERATION OF CAUSTIC |
| 7585 | CHEMICALLY ACTIVE VAPOR/LIQUID SEPARATOR |

FIELD OF THE INVENTION

This invention relates to regeneration of solid beds of caustic which are coated with salts.

BACKGROUND OF THE INVENTION

Treating petroleum fractions to remove acidic and basic components thereof has been practiced for many decades. In the early days of refining acidic components such as hydrogen sulfide and even mercaptans were removed by treatment with caustic solution.

Some attempts were made to simply use solid beds of caustic to remove acidic components from refinery and petrochemical streams, but these have not been too widely used as the beds usually plug or become coated with salts, reducing their effectiveness.

U.S. Pat. No. 3,254,137, Hutto el describe use of a solid KOH caustic treater to remove HF from propane.

A bed of granular alkalies was used to treat a variety of liquid hydrocarbon streams in Sun U.S. Pat. No. 3,761,534, which is incorporated by reference.

Example 1 used 4–8 mesh granular NaOH to remove sulfuric acid from an alkylate stream of tert.-butylated ethyl-benzene containing about 0.3 N total acid, primarily sulfuric acid. Although efficient acid removal first occurred, the bed plugged before 100 volumes of alkylate could flow through the bed.

Example 4 used no NaOH, but treated an effluent from the alkylation of benzene with ethylene in the presence of HCl with soda lime and glassmaker's (G.M.) alkali to remove acid.

Example 5 used pellets of C. P. NaOH to treat crude tert. butylated ethyl-benzene containing 570 ppm $H_2SO_4$. NaOH pellets plugged at 92 weights of alkylate per weight of alkali, while beds of soda lime and G. M. alkali did not plug.

Example 7 used G. M. alkali on a support grid to treat crude tert.butylated ethylbenzene containing about 600 ppm sulfuric acid. The organic flowed up through the support grid, through the alkali to an outlet above the bed of alkali. A white precipitate built up in the reservoir below the grid, which was periodically removed through a drain valve by a water purge. The bed of alkali was reported essentially unchanged by casual observation and there was no increase in resistance to flow through it.

The streams treated in '534 were probably saturated with water, as periodic water purges were reported in many examples, and salts seemed to collect as solid deposits in a sump under the bed of alkaline solid. Some of the results reported could be summarized as follows:

U.S. Pat. No. 3,658,694 McCreary et al disclosed use of lump caustic to treat hydrocarbons, with centrifugal separation of lump caustic from fluid hydrocarbon.

U.S. Pat. No. 4,316,998 Van Pool described water washing a propane stream to remove HF, then drying the resulting stream by passage over solid caustic alkali.

U.S. Pat. No. 5,330,946 discussed removing thiophene or mercaptans in an extractor feed by passing a benzene fraction over solid caustic.

Although some use has been made, as described above, of solid caustic to treat or sometimes dry hydrocarbon streams, this has never been very popular. There are several reasons for the limited use of this inexpensive alkaline reagent.

Solid caustic can not be used to treat aqueous streams. All the caustic would soon dissolve.

Solid caustic used as a bed of solid particles to treat relatively dry hydrocarbon streams containing acid contaminants will soon plug. Salts form and rapidly plug the bed and/or cause the bed to fuse into a solid mass. Such beds are difficult to regenerate, because if water washing is used to remove the salt much of the caustic will also dissolve.

Some attempts have been made to overcome the shortcomings of conventional solid caustic beds. Many refiners use caustic impregnated solids, such as caustic impregnated alumina, to remove acidic components from refinery streams. While such beds are mechanically stronger than neat caustic, the beds are still susceptible to plugging, and cost far more because the caustic is only 5 or 10 wt % of the alumina treater.

Alumina beds can exhibit catalytic activity. When alumina beds are used to remove chlorides from flowing vapor streams, aluminum chloride can form, and cause catalytic reactions which convert some of the hydrocarbon vapor species into a much higher molecular weight material. In some units, the gas is turned to goo, at least enough is formed that the effectiveness of the alumina bed is much impaired. This heavy viscous material must be removed to "regenerate" the alumina bed, so that it may be used to absorb additional amounts of chlorides or other acidic components from the flowing gas stream. Steam stripping will usually "regenerate" such a bed.

Disposal of solid adsorbents can be a serious waste management problem. Solid bed adsorbents must eventually be retired and frequently contains too much hydrocarbon to permit dumping in a landfill. The adsorbent bed may be steam stripped as a prelude to disposal. The resulting water/hydrocarbon product must be stripped to remove benzene from the waste water.

I have discovered a way to use a simple solid caustic bed to remove acidic components from relatively dry liquid or vapor streams in refinery and petrochemical processes and the like. My method can be used to regenerate solid caustic particles used to remove acidic contaminants such as chlorides from relatively dry streams such as reformate.

Instead of using water to wash salts from the bed (and dissolve much of the solid caustic and create an alkaline disposal problem), I use a hydrocarbon continuous phase. If this phase contains small amounts of entrained or even simply dissolved water the salt can be selectively dissolved.

Surprisingly, this approach effectively removes salt deposits from caustic beds, without removing appreciable amounts of the solid caustic. The method can even produce a salt water wash liquor which is almost neutral.

BRIEF SUMMARY OF THE INVENTION

Accordingly, the present invention provides a process for producing a low halide reformate using a Pt and halogen containing reforming catalyst comprising:

a. hydrotreating and distilling a naphtha fraction to produce a hydrotreated naphtha containing less than 1 wt ppm acidic halide compounds and less than 50 wt ppm water;

b. catalytically reforming said hydrotreated naphtha over a halogen and Pt containing reforming catalyst at catalytic reforming conditions to produce a reformate liquid fraction containing at least 0.1 wt ppm acidic halide compounds and less than 25 wt ppm water; and c. depositing solid salt deposits on a bed of solid caustic by contacting said reformate liquid containing acidic halide compounds with solid caustic at reaction conditions sufficient to remove at least a majority of said acidic halide compounds and produce:

a de-halided reformate which is removed from contact with said solid caustic as a product of the process, and solid caustic containing solid salt deposits; and d. regenerating, at least periodically, said solid caustic containing solid salt deposits by contacting said solid caustic with a wash liquid hydrocarbon phase containing dissolved or entrained water, and wherein the water content of said liquid hydrocarbon phase is greater than that of said reformate liquid fraction, to produce solid caustic containing no or less solid deposits.

In another embodiment, the present invention provides a process for removing solid salt deposits from solid particles of caustic comprising:

washing said solid particles with a hydrocarbon liquid phase saturated with water to produce a wash liquor containing dissolved salt and solid particles of caustic containing a reduced amount of solid salt deposits;

extracting or removing salt from said wash liquor by contact with an aqueous phase to produce an aqueous phase containing dissolved salt deposits and a regenerated hydrocarbon phase saturated with water; and recycling said regenerated hydrocarbon phase to contact said solid particles of caustic.

In yet another embodiment, the present invention provides a method of removing acidic halides from a flowing vapor stream comprising:

a. charging a flow vapor stream containing at least 0.1 wt ppm acidic halide and less than 100 vol ppm water through a bed of solid caustic material, and wherein the halide content of the gas and the water content of the gas are such as to form solid salt deposits on said solid caustic material in an amount sufficient to reduce the effectiveness of said solid caustic for halide removal;

b. periodically removing said solid caustic from contact with said flowing vapor stream;

c. periodically regenerating said solid caustic by contact with a liquid hydrocarbon stream which is saturated with water but contains less than 1 wt % entrained water and dissolving said solid deposits in said dissolved and/or entrained water from said solid caustic to produce a substantially salt free surface on said solid caustic particles; and d. returning said substantially salt free solid caustic particles to contact with said flowing gas stream.

BRIEF DESCRIPTION OF THE DRAWINGS

The Figure is a simplified schematic view of a preferred solvent saturator and salt extractor used in conjunction with a solid caustic reactor treating a liquid reformate stream.

DETAILED DESCRIPTION OF PREFERRED EMBODIMENTS

The invention can be better understood in conjunction with a review of the Figure.

The Pt reformer is shown largely as a box 10, to which feed in line 21 and recycle hydrogen in line 26 are added and from which reactor effluent is removed via line 12. Not shown are heaters, pumps, valves and much other process equipment. Chlorine or compounds thereof will usually be injected either with the feed, or added directly or indirectly via catalyst regeneration. The reactor effluent vapor, after heat exchange with feed and cooling by means not shown, is charged via line 12 to vapor liquid separator 20. A recycle hydrogen stream is withdrawn from the separator via line 22 and recycled via line 26 to reactor 10. The net gas make is withdrawn via line 28. These parts of the reformer are conventional and form no part of the present invention.

Reformate liquid is withdrawn from the separator via line 24 and charged to solid caustic treater 30, shown partially in cross section. Basically the treater is a large fixed bed containing solid caustic. The caustic solids can be mixed with, or held by, solid supports such as activated carbon, woods, fibers, etc, or solid caustic pellets may be supported by a screen or grid 45 in the base of the treater.

Reformate is added to the top of the treater, passes down through bed 40, through screen 45 and is withdrawn via line 32 for further processing in means not shown, such as a conventional debutanizer. Reformate can also flow up through the bed.

A boot 35 in the base of treater 30 permits removal of any aqueous phase which may be present. During normal operation there will be no water phase during treating, because the reformate is a dry stream. During rejuvenation, there need not be, and usually will not be, a water phase in the boot 35, though it is probably prudent to provide a boot so that any water phase which forms may be withdrawn. The rejuvenation procedure will be reviewed below.

The treater 30 may be periodically removed from service or bypassed by means not shown, for bed rejuvenation. For this, some reformate, or even fresh feed or other hydrocarbon liquid, is circulated in a loop from treater 30 to solvent saturator and salt extractor 50 as discussed hereafter. A liquid hydrocarbon stream saturated with water and perhaps containing a minor amount of entrained water is charged via line 52 into the top of treater 40. The hydrocarbon continuous phase passes through the bed of solid caustic, and the water in the hydrocarbon selectively dissolves the soft salt deposits on the surface of the solid caustic pellets to form brine.

If too much water is added, or is entrained in the hydrocarbon phase, a brine phase may form in boot 35 in the base of treater 30, with reformate or hydrocarbon charged via line 32 to downstream processing. In this type of operation the brine is simply removed via lines 37, 42 and 43 and discarded.

Preferably, the entire hydrocarbon stream passing through the caustic bed is withdrawn via lines 37 and 39 and charged to solvent saturator and salt extractor 50. Water may be maintained in this vessel in the lower portion of a packed bed 56, with a water/hydrocarbon interface 55. Passage of the hydrocarbon phase through the water removes salt from the hydrocarbon, and saturates the hydrocarbon for reuse via line 52. A brine phase may be withdrawn via line 54 and sent via line 43 to the refinery waste treatment facility.

More details will now be provided about each part of the process. One of the most troublesome refinery streams to treat is reformate. Pt reformers are used in almost every refinery to make high octane reformate. These streams are large, dry and most now have large amounts of chlorides. This process will be reviewed in more length below.

CATALYTIC REFORMING

This process is well known and widely used, most refineries have catalytic reforming units. Essentially all catalytic reformers operate with chlorine addition, either to the catalyst prior to startup, to the feed during normal operation, or as part of a continuous catalyst regeneration unit associated with a moving bed reformer.

Reformers are available from several licensors. UOP Inc, Des Plaines, Ill. will provide both fixed and moving bed reforming units.

Conventional reforming conditions can be used, including a temperature of 850° to 1050° F., a pressure of atmospheric to 500 psig and a LHSV of 0.1 to 10 Hr-1. Most reformers operate with recycle hydrogen, with from a 1:1 to 10:1 H2:hydrocarbon mole ratio.

CHLORINE IN REFORMATE

Moving bed units frequently produce reformate with more than 0.5 wt ppm Cl, and often in excess of 1 wt ppm Cl, and sometimes with 2 or 3+ wt ppm Cl. Fixed bed units operating with large amounts of Cl addition due to catalyst demands or imminent shutdown for regeneration can produce reformate with like amounts of Cl, though typically moving bed units have the highest Cl levels.

Chlorine levels may be continuously, or intermittently, troublesome. Chlorine in reformate will usually be highest just before regeneration (for fixed bed units) or just before replacement of catalyst (in the case of moving bed units).

Some refiners may use other halogens such as F in full or partial replacement of Cl. My process will efficiently capture salts made from these materials as well.

CHLORIDES IN REFORMER OFF GAS STREAMS

While chlorides in reformate are the most troublesome stream in many refiners, the various off gas streams from the reformer frequently contain excessive amounts of acidic components. The net recycle gas make is frequently used in downstream hydrogen consuming processes, and chlorides in this stream can cause mischief in downstream hydroprocesses.

The reformer debutanizer overhead receiver off gas may be burned as fuel or sent to various gas treating facilities. Chlorides can cause corrosion when present in fuel gas, and can cause difficulties in gas processing plants.

Thus the various gas streams produced by a dry process such as Pt reforming may also be beneficially treated by contact with a solid bed of caustic for removal of acidic species. Such resulting dry salt deposits may be efficiently removed using my hydrocarbon based process.

SOLID CAUSTIC TREATING

The process used to deposit dry salt is very simple. A dry reformate (or a dry chloride containing gas stream) passes over a bed of solid caustic. No water is added, nor any other chemicals except for the initial load of solid caustic. The bed will rapidly or slowly, depending on size, space velocity, etc., become coated with salt. The salt coated solid caustic bed is then regenerated using a hydrocarbon continuous phase containing limited amounts of water.

The chemistry of salt formation is simple. Simple neutralization reactions are involved which proceed rapidly. the primary reactions involved are:

$$HCl+NaOH \rightarrow NaCl+H_2O$$

$$NH_4Cl+NaOH \rightarrow NH_3+NaCl+H_2O$$

The reaction products, salts, will generally simply deposit upon the solid caustic particles. A clean naphtha exits the reactor and is charged to the debutanizer. This part of the process will rapidly coat the solid caustic bed with salt.

The trick is not in forming solid salt deposits by reacting acidic materials in reformate but rather in dissolving the salt deposits without dissolving the solid caustic bed and preferably without generating a caustic waste stream. The regeneration step will be reviewed after the following review of types of solid caustic which may be used.

The solid caustic may be in the form of pure particles of a suitable caustic material, such as NaOH, KOH, CaO, MgO and the like. This material may be extruded, pilled, prilled, or formed using conventional techniques into any desired shape, preferably one with a high surface area to volume ratio which is mechanically strong and allows free flow of liquids.

To improve material handling it may be beneficial to add conventional solid supports to or around the solid caustic. Thus the caustic solids can be mixed with activated carbon, porous resins, woods, fibers and the like. When a support is used it preferably comprises a minority of the reactive solid, so that a majority, by weight, of the reactive solid used in the bed is caustic.

Alternatively the solid caustic may be in baskets or fiber bags, perforated tubes, trays or the like.

Even conventional solid caustic treated supports, such as caustic impregnated alumina, can be regenerated using my method. There are many installations containing such materials, and my method may be used to efficiently remove solid salt deposits which may form on such beds.

REACTION CONDITIONS

Like most inorganic reactions, the reaction of halide species, usually chlorides, with solid alkaline materials proceeds rapidly. In functional terms, contact should be long enough to remove at least a majority, and preferably more than 70%, and most preferably more than 90% of the chlorides in the reformate or the gas stream. Short contact times reduce the size of the equipment, but will require more frequent regeneration of the solid caustic bed.

The typical operating conditions are temperatures of 0° to 700° F., preferably 32 to 500° F. The superficial vapor velocity through the bed may range from 1 to 1000 ft/min, preferably from 5 to 300 fpm. In terms of gas hourly space velocity, GHSV, the process works well with 0.1 to 100 *10**6 v/vH, and preferably with 0.5 to 20 *10**6 v/vH. Pressures may vary greatly, with pressures from 0 to 5000 psig, preferably from 0 to 2000 psig.

In general, the process works well at the conditions found downstream of the vapor/liquid separator of the reformer, and downstream of the debutanizer overhead receiver. Pressures should be high enough to maintain liquid phase operation, when a liquid hydrocarbon stream is being treated.

The major corrosion components in the reformate are HCl, $NH_4Cl$ and $FeCl_3$. The feed containing these corrosive components may be simply introduced at 70° to 180° F. from the bottom of the reactor and passed through the bed of solid caustic.

The major corrosion components in reformer gas streams are usually chlorides. The gas stream may be passed at whatever conditions it happens to be through a bed of solid caustic, where most of the acidic components will be removed.

Details on some of the types of acidic halides present in refinery streams, and the salts they form, are disclosed in *Calculations estimate process stream depositions,* Oil & Gas Journal, Jan. 3, 1994 pp 38–41, Yiing-Mei Wu. This article is incorporated by reference. It is cited to provide details on some of the many chemical species which exist in refinery and petrochemical streams.

Water is formed by the same neutralization which produces the salts which deposit on the bed of solid caustic. The process will usually run without formation of a separate aqueous phase, and preferably does so when simplicity and reliability of design of the solid caustic bed is of paramount importance to the process designer. Since catalytic reforming is such a dry process the minor amounts of water will generally remain primarily in the process stream, it is this phenomenon which causes solid salt deposits to build up on the bed of caustic in the first place.

Entrainment of caustic or brine in reformate is undesirable and usually not a problem because no brine need ever form if dry caustic is used for halide removal. Formation of a brine film on the bed of solid caustic will usually increase chloride removal, but makes design of the bed much more complicated because brine disposal/entrainment must be considered.

The point of the present invention is to have a simple and reliable way to restore the activity of a bed of solid caustic which has to deal only with two phases—solid caustic and the flowing process stream (either a hydrocarbon liquid or a vapor stream).

Caustic is used stoichiometrically, not catalytically. Caustic is continuously consumed in the process and the solid caustic bed will eventually be coated with salt. It is the removal of this salt deposit which is the essence of the present invention, and which permits reuse of the solid bed of caustic.

REACTOR DESIGN

While many types of reactor design can be used, one of the great benefits of my process is that it permits a simple fixed bed reactor to be used, which need not be designed to accommodate an aqueous phase.

When a simple fixed bed reactor is used, solid caustic may be simply dumped onto dumped structured packing. For such a reactor, the following guidelines can be given. The reactor preferably contains structured packing (~0–5% of separator volume) in a lower portion and solid caustic (70–90% of volume). About 10–30% at the top can be empty. Either upflow, downflow or cross-flow operation is possible.

Either upflow, downflow or cross-flow operation is possible. Moving bed, or fluidized beds may also be used, but most refiners will prefer to use a simple fixed bed system.

BED REGENERATION

The bed may be regenerated in situ so long as facilities are available to at least periodically wash the bed of caustic with a hydrocarbon phase. Regeneration conditions are not narrowly critical, so long as a hydrocarbon continuous phase, with a strictly controlled amount of water, is used to dissolve the salt from the surface of the solid caustic.

Regeneration conditions which may be used include temperatures of 0° to 500° F., preferably 32° to 300° F. The solvent by be any NaOH insoluble solvent, and preferably is a light normally liquid hydrocarbon, and most preferably naphtha or reformate. The solvent rate through the bed is preferably from 0.1 to 100 cm/min, and more preferably 2 to 30 cm/min. Pressure should be sufficient to maintain a liquid phase, and preferably is from 0 to 1000 psig, and more preferably from 0 to 500 psig.

The flow through the bed during regeneration may be the same or different than process flow during use removing acidic components from a flowing stream. Thus the process stream can pass downflow through the bed, and the regeneration liquid can flow up through the bed, or vice versa.

It is essential that the bed be regenerated with a liquid hydrocarbon continuous stream. If water were passed over or through the bed that would dissolve not only the salt deposit, but much of the caustic. This would remove prematurely much of the caustic bed, and create a highly alkaline disposal problem.

The liquid hydrocarbon used to remove salt from the solid caustic must have more water in it than a flowing reformate stream, which typically has no more than 10 wt ppm water. The minimum amount at which a reasonable rate of bed regeneration may be achieved is probably around 50 wt ppm. Preferably the salt wash hydrocarbon stream contains an equilibrium amount of water, typically around 80 to 100 wt ppm, depending on the hydrocarbon stream and temperature. Even faster salt washing may be achieved if the liquid hydrocarbon contains some entrained water, ranging from a few wt ppm entrained water up to that amount of water which may be present while maintaining a hydrocarbon continuous phase.

In most situations, a reformate or naphtha hydrocarbon stream saturated with water, or containing up to 10 wt % water, may be used with good results. Provisions must be made for adding such a liquid hydrocarbon stream containing this amount of water, or separate liquid hydrocarbon and water addition means may be provided to the reactor.

If the liquid hydrocarbon added will have entrained water, it will be best to have downflow or cross-flow operation through a fixed bed of solid caustic, so that no continuous aqueous phase will form.

While liquid reformate will usually be the preferred regeneration stream around a reformer, other streams may be used, which may introduce some contaminants. Thus FCC heavy naphtha could be used to regenerate the bed.

Relatively light or heavy liquid hydrocarbon streams may be used to wash the salt off, e.g., propane, butanes, pentanes, benzene, toluene, xylenes, and various mixtures of these streams. It may be beneficial to use a light hydrocarbon stream, such as butane, to regenerate some beds of solid caustic, because the liquid hydrocarbon may be effectively removed from the bed at the end of the process by simply depressuring the vessel containing the solid bed of caustic.

EXAMPLE 1

Feed

A dry chloride containing off gas was simulated with a stream of dry nitrogen gas which was passed through a flask containing concentrated HCl. The nitrogen gas contained from 43 ppm to 185 ppm HCl.

Reactor

The reactor was 400 g of NaOH beads packed in a glass reactor of 4.5 cm ID. This amount of caustic formed a bed 23 cm high.

Operating Procedure

The nitrogen gas doped with HCl was passed up through the bed at 16.6 l/min. and 0.58 feet/sec. The removal efficiency started at 88.5%, and gradually dropped to 77.3% after 55 hours of operation. At this point the NaOH had picked up about 2 g of HCl per 100 g of NaOH.

The bed was then regenerated with 5 bed volumes of water saturated naphtha for four times. The naphtha was pumped upflow through the bed. The water in the naphtha dissolved the salt crystals and regenerated the surface of the solid particles of NaOH. The regeneration effluent (the naphtha saturated with water) was then extracted with liquid water to remove the NaCl and saturate the naphtha for reuse in washing salt off of NaOH. The regeneration is considered complete when the effluent of the regeneration solution is substantially NaCl free.

In this regeneration, the NaCl is selectively washed without dissolving NaOH, because the pH of the aqueous effluent is only about 8.6 from the naphtha water washing step.

Upon returning to the second cycle of adsorption, the HCl removal efficiency was back to about 90%.

Salt crystals were observed on the solid caustic, and analytical results showed the effectiveness of the bed was declining in proportion to the salt build up.

EXAMPLE 2

The experiment was repeated, at exactly similar conditions of superficial vapor velocity, gas composition, etc., but this time a 1.3 cm ID reactor was used. Although the reactor was much smaller in Ex. 2 than in Ex. 1, the experimental results were essentially the same, showing that the unit will perform well in large size commercial units, i.e., performance is relatively independent of reactor size.

SIGNIFICANCE

This solid bed extraction process gives refiners a simple and reliable way to remove most of the acidic components from dry process streams. A fixed bed reactor may be used, and although it will eventually foul with a layer of salt deposits, the bed may be readily regenerated using the new, hydrocarbon continuous, salt washing process of the invention. It is now possible to remove the salt layer without dissolving the underlying solid caustic material. The solid caustic bed is regenerated, and the salt solution eventually obtained from the bed need not be overly alkaline, which reflects the efficiency of the salt removal process. This hydrocarbon continuous salt washing process also permits efficient removal of acidic components, without generation of large volumes of dilute caustic for disposal.

Based on visual observation, and experiments for chloride removal, the salt bed does not appear to plug or clump, and its efficacy for chloride removal is completely restored by the hydrocarbon continuous salt washing procedure.

This regeneration procedure makes practical, for the first time, the use of solid caustic for treating relatively dry streams containing acidic components. The process is significant not only for what it does (efficiently remove most of the acidic components from a stream) but for what it does not do. Thus my process does not add any water to the flowing process stream, has no aqueous phase in contact with the flowing process stream, and generates no waste stream other than mildly alkaline brine.

The process of the present invention may be used to regenerate beds of salt coated solid caustic. Many refinery and petrochemical streams are relatively dry but contain acidic components which will form salts when contacted with a bed of solid caustic. Using this exquisitely sensitive method of dissolving a water soluble salt in oil, refiners can now efficiently use, and reuse, solid caustics for many applications.

This process is also applicable to clean gases containing other acid components such as H2S, SO2 and SO3.

I claim:

1. A process for producing a low halide reformate using a Pt and halogen containing reforming catalyst comprising:

a. hydrotreating and distilling a naphtha fraction to produce a hydrotreated naphtha containing less than 1 wt ppm acidic halide compounds and less than 50 wt ppm water;

b. catalytically reforming said hydrotreated naphtha over a halogen and Pt containing reforming catalyst at catalytic reforming conditions to produce a reformate liquid fraction containing at least 0.1 wt ppm acidic halide compounds and less than 25 wt ppm water; and c. depositing solid salt deposits on a bed of solid caustic by contacting said reformate liquid containing acidic halide compounds with solid caustic at reaction conditions sufficient to remove at least a majority of said acidic halide compounds and produce:

a de-halided reformate which is removed from contact with said solid caustic as a product of the process, and solid caustic containing solid salt deposits; and d. regenerating, at least periodically, said solid caustic containing solid salt deposits by contacting said solid caustic with a wash liquid hydrocarbon phase containing dissolved or entrained water, and wherein the water content of said liquid hydrocarbon phase is greater than that of said reformate liquid fraction, to produce solid caustic containing no or less solid deposits.

2. The process of claim 1 wherein the halide is chlorine.

3. The process of claim 1 wherein the liquid reformate contains more than 1.0 wt ppm chlorine as HCl, NH4Cl, FeCl3 and mixtures thereof, and wherein more than 70% of said chlorine is removed.

4. The process of claim 1 wherein said solid caustic comprises at least 0.01 wt % NaOH, KOH or mixtures thereof.

5. The process of claim 1 wherein said solid caustic is essentially pure NaOH or KOH.

6. The process of claim 1 wherein said solid caustic contains or is mixed with a solid support.

7. The process of claim 6 wherein said solid caustic is contained in porous bags, perforated pipe, or screens.

8. The process of claim 7 wherein said wash liquid hydrocarbon phase is reformate saturated with water.

9. The process of claim 1 wherein:

said wash liquid hydrocarbon is passed through said solid caustic to produce a wash liquor, said wash liquor is extracted with a liquid water phase to produce a salt containing aqueous phase and a regenerated hydrocarbon liquid phase which is saturated with water, and said regenerated hydrocarbon liquid phase is recycle to said solid caustic to remove additional amounts of solid deposits.

* * * * *